US007172069B2

(12) United States Patent
Coffin et al.

(10) Patent No.: US 7,172,069 B2
(45) Date of Patent: Feb. 6, 2007

(54) CONTAINER FOR A REPLACEMENT CARTRIDGE

(75) Inventors: David Coffin, Hamden, CT (US); Chris A. Barone, Trumbull, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/431,250

(22) Filed: May 7, 2003

(65) Prior Publication Data

US 2003/0209457 A1 Nov. 13, 2003

Related U.S. Application Data

(60) Provisional application No. 60/433,404, filed on Dec. 13, 2002, provisional application No. 60/378,332, filed on May 7, 2002.

(51) Int. Cl.
*A45C 11/26* (2006.01)
*A45D 27/22* (2006.01)

(52) U.S. Cl. ..... 206/352; 206/208; 206/228; 206/477; 30/541

(58) Field of Classification Search ..... 206/352, 206/354–356, 359, 363, 228, 438, 207, 208, 206/723, 815, 477, 480; 30/541, 40.2, 84, 30/535, 536, 539; 132/289, 292
See application file for complete search history.

(56) References Cited

U.S. PATENT DOCUMENTS 3,367,482 A * 2/1968 Samsing ..... 206/228
3,848,440 A * 11/1974 Manuel ..... 206/527
4,191,293 A 3/1980 Newman
4,564,880 A * 1/1986 Christ et al. ..... 206/723
4,842,141 A 6/1989 Segal
5,031,317 A 7/1991 Jacobson
5,143,218 A 9/1992 Brauckmann
5,297,679 A 3/1994 Rondone et al.
5,490,329 A 2/1996 Chylinski et al.
5,667,063 A * 9/1997 Abe ..... 206/204
5,950,830 A * 9/1999 Trigger ..... 206/440
6,311,838 B1 * 11/2001 Johnson et al. ..... 206/363
6,415,517 B1 * 7/2002 Worrick, III ..... 206/228
6,499,595 B1 * 12/2002 Petricca ..... 206/356

FOREIGN PATENT DOCUMENTS

EP 1 125 697 A1 8/2001

* cited by examiner

*Primary Examiner*—Mickey Yu
*Assistant Examiner*—J. Gregory Pickett
(74) *Attorney, Agent, or Firm*—Michaud-Duffy Group LLP

(57) ABSTRACT

A replacement cartridge container is provided that includes a tub and a selectively removable lid. The tub includes a base panel attached to a side panel. The base panel and the side panel each have an interior surface and an exterior surface. A cavity is formed contiguous with the interior surfaces of the base panel and the side panel. The selectively removable lid attaches to the tub and forms a seal with the tub.

22 Claims, 5 Drawing Sheets

CONTAINER FOR A REPLACEMENT CARTRIDGE

This application claims the benefit of and incorporates by reference essential subject matter disclosed in U.S. Provisional Patent Application Nos. 60/378,332 filed on May 7, 2002, and 60/433,404 filed on Dec. 13, 2002.

BACKGROUND OF THE INVENTION

1. Technical Field

This invention relates to shaving devices that utilize a replaceable cartridge in general, and to containers for such replacement cartridges in particular.

2. Background Information

A razor assembly for use in a wet shaving environment includes a body of shaving aid material typically located in close proximity to a razor cartridge. Shaving aid materials include, but are not limited to lubricating agents, drag reducing agents, depilatory agents, cleaning agents, medicinal agents, and the like that enhance the shaving process. It is desirable to periodically replace the shaving aid body or the razor cartridge, and often both are replaced together. Shaving aid materials often contain one or more volatile components (e.g., moisture, alcohol, fragrance, etc.) that can escape and detrimentally affect the shaving aid body. In addition, shaving aid materials do not, relatively speaking, possess significant mechanical strength. Consequently, a shaving aid body can be susceptible to damage during shipping to the consumer.

There is, therefore, a need for a container that can house a replacement cartridge for a razor assembly that includes a shaving aid body alone or in combination with the razor cartridge.

DISCLOSURE OF THE INVENTION

It is, therefore, an object of the present invention to provide a container for a razor assembly replacement cartridge. There is also a need for a replacement cartridge container that will protect the replacement cartridge, one that will facilitate attachment of the replacement cartridge, and one that is suitable for use in the consumer market place.

According to the present invention, a replacement cartridge container is provided that includes a tub and a selectively removable lid. The tub includes a base panel and a side panel attached to one another. The base panel and the side panel each have an interior surface and an exterior surface. A cavity is formed contiguous with the interior surfaces of the base panel and the side panel. The selectively removable lid attaches to the tub and forms a seal with the tub.

An advantage of the present invention is that the container protects the replacement cartridge. The replacement cartridge typically includes a shaving aid body that includes one or more volatile constituents. The present replacement cartridge container protects the shaving aid body by limiting the leakage flow into or out of the container, thereby preventing undesirable leakage of the volatile constituents. The present container also protects the replacement cartridge by locating the replacement cartridge within the tub at a position such that an air gap is disposed around most if not all of the replacement cartridge.

Another advantage of the present invention is that the container facilitates attachment of the replacement cartridge to the razor assembly. Regardless of whether the replacement cartridge includes a shaving aid body alone, or in combination with a razor cartridge, or in combination with a razor cartridge and a member linking the razor cartridge and the shaving aid body together, the container securely positions the replacement cartridge to allow the attachment of the shaving aid body, razor cartridge, and/or linkage member to the razor assembly.

These and other objects, features, and advantages of the present invention will become apparent in light of the detailed description of the present invention.

DETAILED DESCRIPTION OF THE INVENTION

Figure 1:
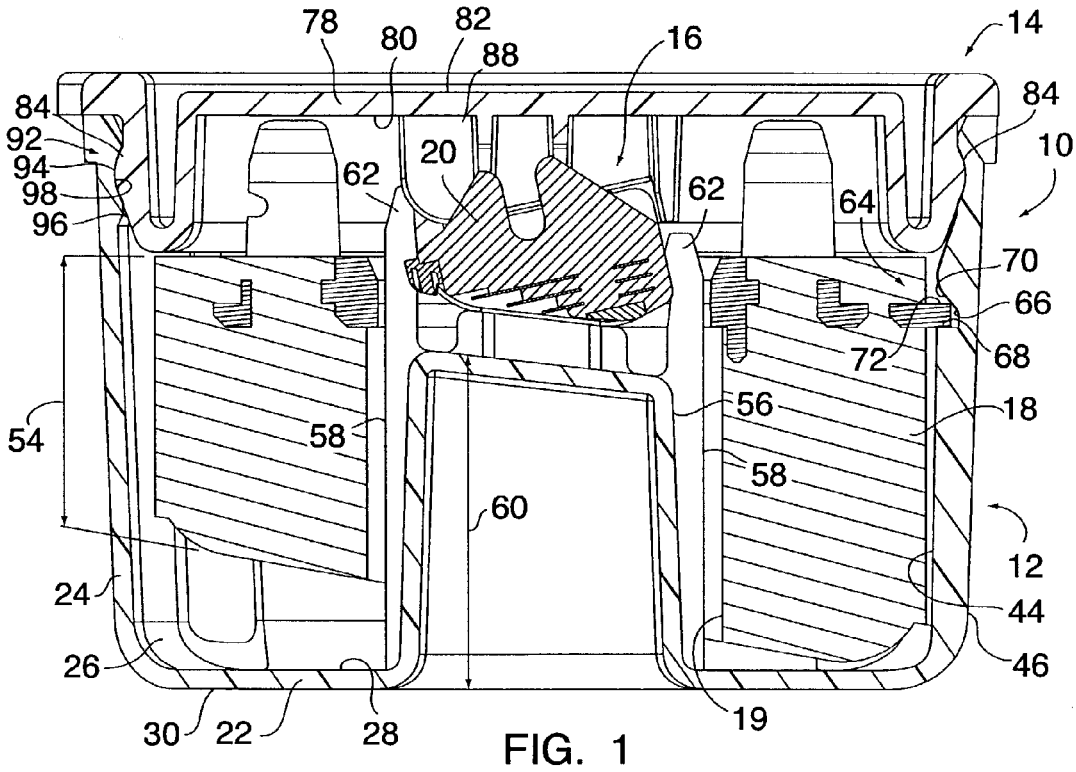
FIG. 1 is a diagrammatic sectional view of an embodiment of the present invention container with a replacement cartridge disposed within the container.
Figure 2:
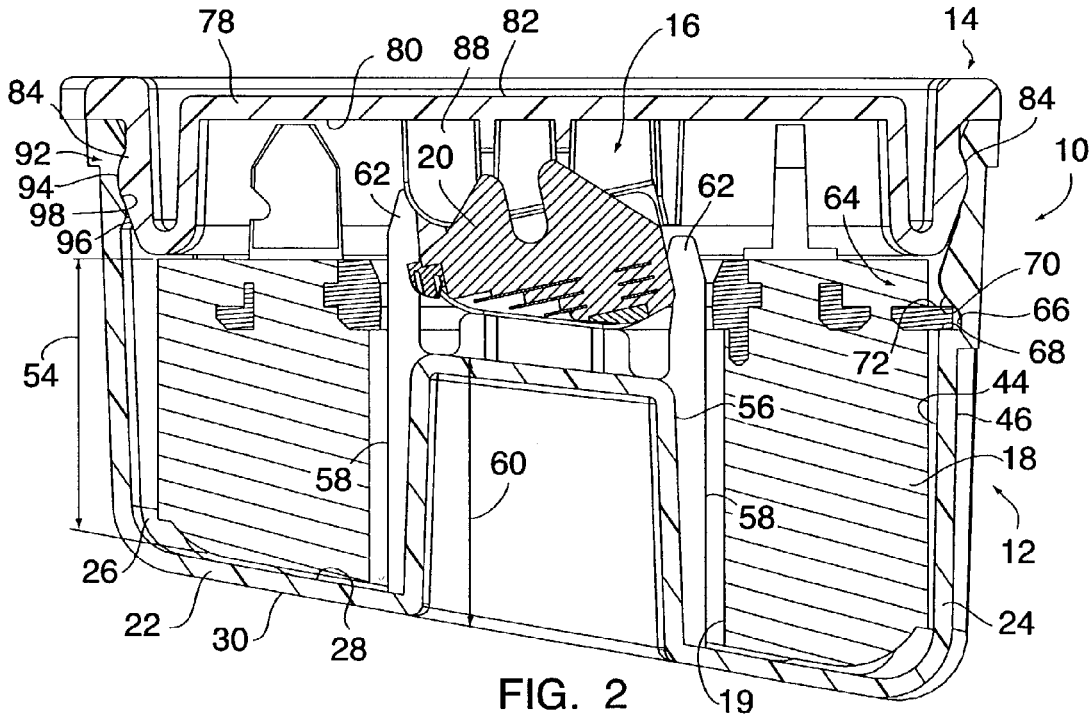
FIG. 2 is a diagrammatic sectional view of an embodiment of the present invention container with a replacement cartridge disposed within the container.
Figure 8:
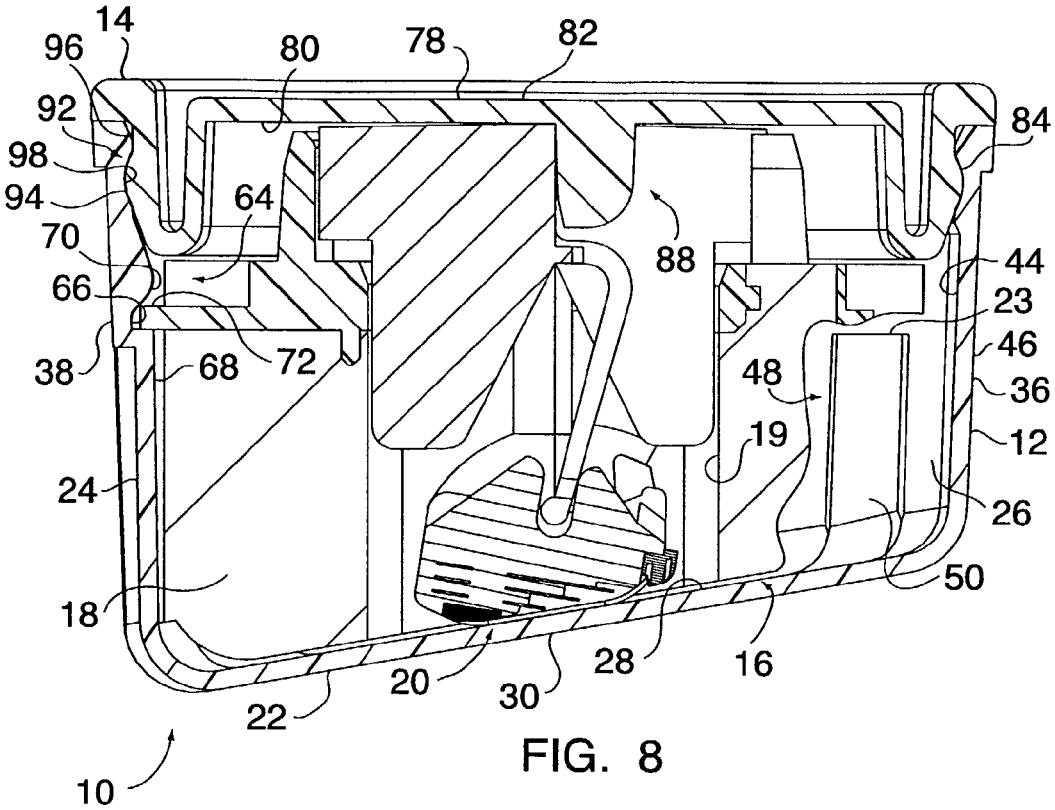
FIG. 8 is a diagrammatic sectional view of an embodiment of the present invention container with a replacement cartridge disposed within the container.

Now referring to FIGS. 1, 2, and 8 a replacement cartridge container 10 that includes a tub 12 and a lid 14 is sized to house a replacement cartridge 16 for a razor assembly 17. The container 10 can be configured to house a variety of different replacement cartridges 16, each of which includes a shaving aid body 18 that consists of one or more shaving aid materials (e.g., lubricating agents, drag reducing agents, depilatory agents, cleaning agents, medicinal agents, etc.). In many embodiments, the replacement cartridges 16 also include a razor cartridge 20. In still other embodiments, the replacement cartridge 16 includes one or more members (see FIG. 8) that link the shaving aid body 18 and the razor cartridge 20 together. An example of a replacement cartridge 16 to which the present container 10 is particularly well suited is one that includes an oval shaped shaving aid body 18 having a center aperture or pocket 19 for receiving a razor cartridge 20. The oval shaped shaving aid body 18 facilitates the deposition of shaving aid material forward, aft, and lateral of the razor cartridge 20. U.S. Provisional Patent Application Ser. Nos. 60/375,844 and 60/375,843 disclose such a razor assembly and replacement cartridge, and are hereby incorporated by reference herein.

Figure 3:
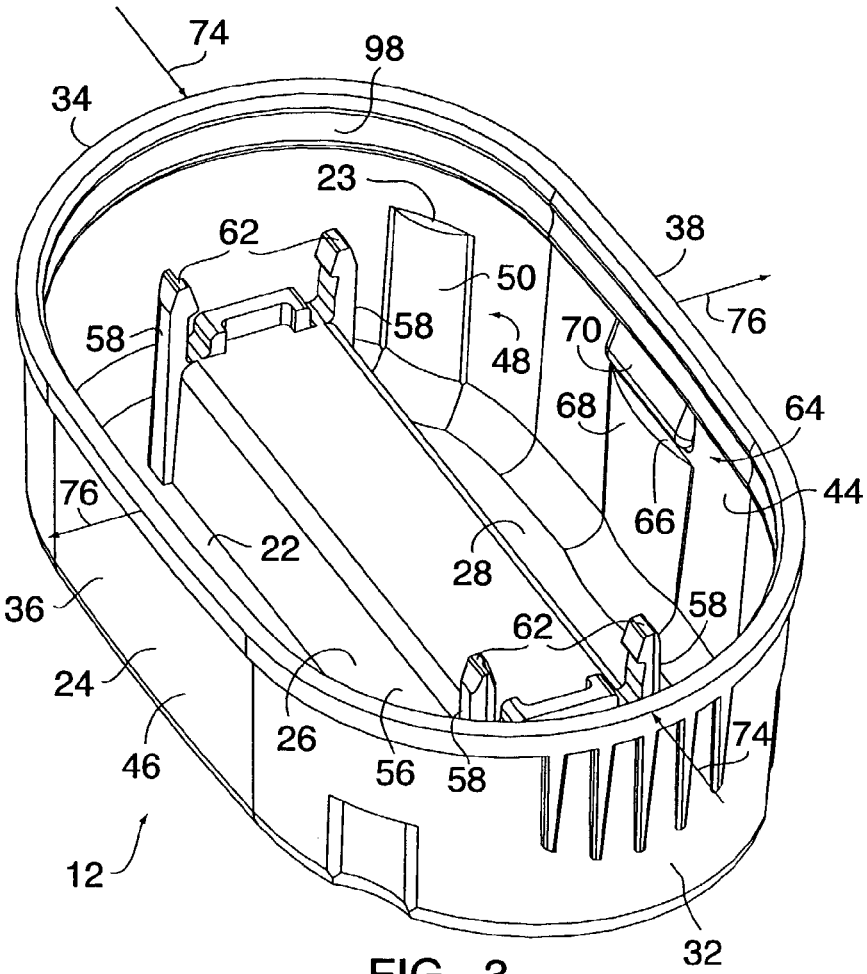
FIG. 3 is a perspective view of the tub of the present container.
Figure 6:
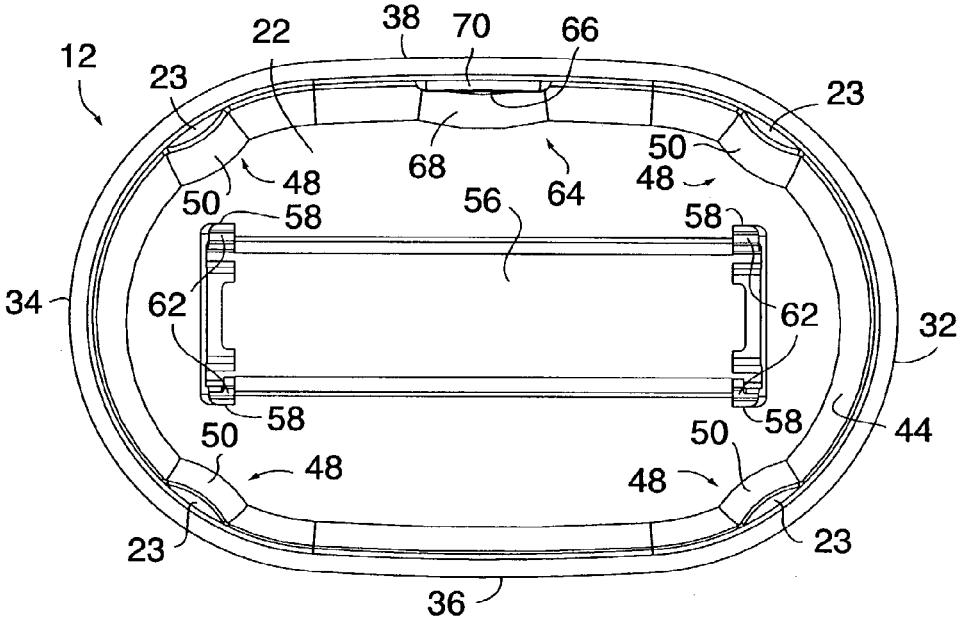
FIG. 6 is a top view of the tub of the present container.

Referring to FIGS. 1–4, 6, and 8, the tub 12 includes a base panel 22 and a side panel 24 attached to one another, or formed together. The base panel 22 has an interior surface 28 and an exterior surface 30. The side panel 24 has an interior surface 44 and an exterior surface 46, and can be described as having one or more sections. The actual number of side panel 24 sections will depend on the geometry of the tub 12; e.g., a cylindrical tub 12 can be described as having one side panel 24 section and a rectangular tub 12 can be described as having four side panel 24 sections, etc. The embodiment shown in the figures, for example, can be described as having two pairs of side panel sections; i.e., a pair of first side panel sections 32,34 and a pair of second side panel sections 36,38. As can be seen in FIGS. 3 and 6, the first side panel sections 32,34 extend between the second side panel sections 36,38 and vice versa. A cavity 26 is formed contiguous with the interior surfaces 28,44 of the base panel 22 and the side panel 24. The relative geometries of the panels 22, 24 can be selected to satisfy the application at hand. For example, FIG. 1 shows a base panel 22 disposed substantially parallel to the lid 14. FIG. 2, in contrast, shows a base panel 22 disposed substantially parallel to a surface of the replacement cartridge 16.

The tub 12 preferably further includes one or more locating features 48 for locating the replacement cartridge 16 within the tub cavity 26. The locating features 48 facilitate attaching the replacement cartridge 16 to the razor assembly by maintaining the replacement cartridge 16 in a desirable position. In addition, the locating features 48 also space the shaving aid body 18 away from the base panel 22 and the side panel 24 of the tub 12. In the embodiment shown in FIGS. 3, 4, and 6, a locating feature 48 in the form of a pedestal 50 is disposed in each corner of the tub 12. The height 52 of each pedestal 50 from the base panel 22 to a top surface 23 of the pedestal 50 is greater than the relative height 54 of the uneroded shaving aid body 18, thereby creating a space between the shaving aid body 18 and the interior surface 28 of the base panel 22. Non-pedestal locating features 48 can be used alternatively.

In the embodiments shown in FIGS. 1–4, 6 and 7, the tub 12 also includes a centrally located riser 56 extending out from the base panel 22. The riser 56 includes a plurality of locating surfaces 58 that are received within the center aperture/pocket 19 of the shaving aid body 18 when the shaving aid body 18 is disposed within the tub 12. Like the above-described locating features 48, the locating surfaces 58 locate the replacement cartridge 16 within the tub 12 and in some instances provide an air gap between the riser 56 and the shaving aid body 18. To accommodate certain replacement cartridges 16 that include a razor cartridge 20, the height 60 of riser 56 from the base panel 22 is selected to locate the razor cartridge 20 in a position that facilitates attachment of the razor cartridge 20 to the razor assembly. One or more clips 62 can be included to selectively secure the razor cartridge 20 to the riser 56. In those embodiments where the replacement cartridge 16 includes one or more members linking the shaving aid body 18 and the razor cartridge 20 together, the riser 56 is eliminated or is sized to accommodate the razor cartridge 20 and the one or more members. FIG. 8, for example, shows an embodiment wherein the container is configured to receive a replacement cartridge that includes linkage members linking the shaving aid body 18 and the razor cartridge. The container embodiment shown in FIG. 8 does not include a riser 56.

The tub 12 preferably further includes a mechanism 64 for securing the replacement cartridge 16 within the tub 12. The mechanism 64 includes a slot 66 formed between a pedestal 68 and a cap 70 attached to one of the second side panel sections 36,38. The slot 66 is sized to receive a tab 72 (see FIGS. 1 and 2) extending out from the shaving aid body 18. In the exemplary embodiment, the tub 12 consists of a flexible thermoplastic material including, but not limited to, a polyethylene or a polypropylene. Pressure applied to the first side panel sections 32,34 (see arrows 74—FIG. 3) causes the second side panel sections 36,38 to flex outwardly (see arrows 76—FIG. 3). When the second side panel sections 36,38 flex outwardly, the tab 72 becomes disengaged from the slot 66 thereby releasing the replacement cartridge 16 from the tub 12. A slot 66 similar to that described above can be formed on one or both second side panel sections 36,38 if desired. The mechanism 64 for securing the replacement cartridge 16 within the tub 12 is not limited to the above-described embodiment. For example, a slot could be formed in the replacement cartridge and a tab attached to the side panel 24.

Figure 5:
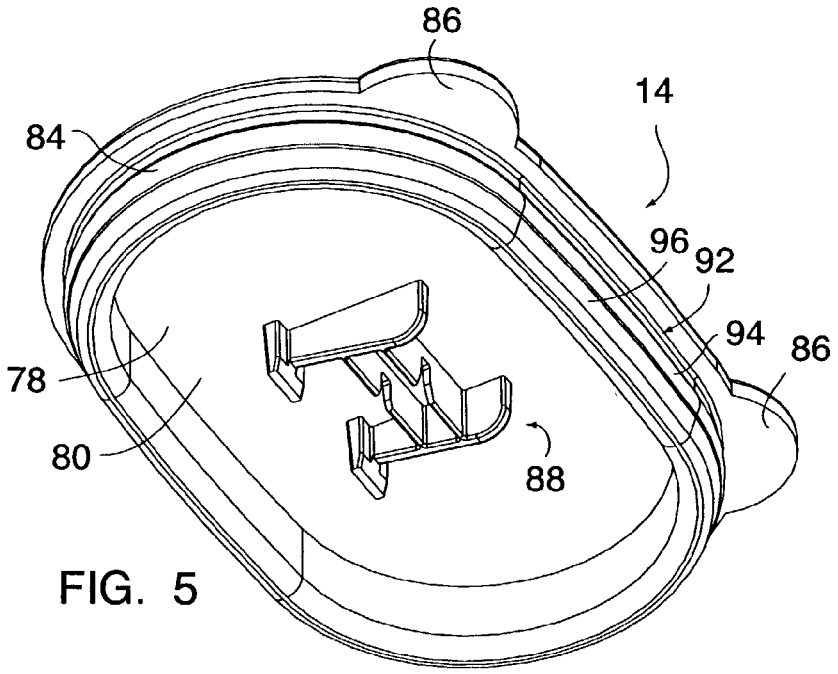
FIG. 5 is a perspective view of the lid of the present container.
Figure 4:
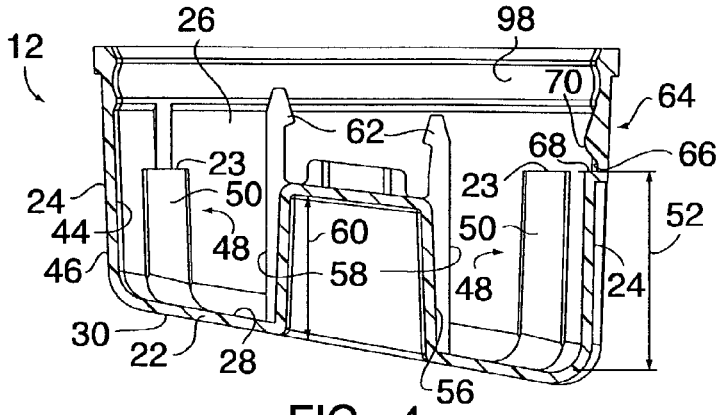
FIG. 4 is a sectional view of the tub of the present container.
Figure 7:
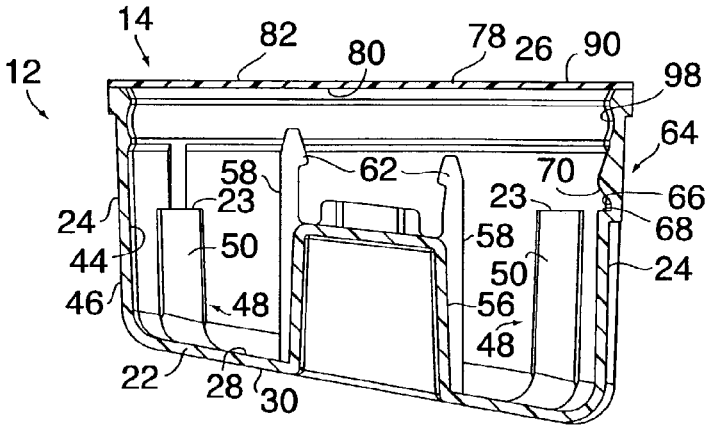
FIG. 7 is a sectional view of an embodiment of the present container.

Now referring to FIGS. 1, 2, and 5, the selectively removable lid 14 includes a panel 78 and a mechanical feature that enables it to be attached to the tub 12, or vice versa. The panel 78 includes an interior surface 80 and an exterior surface 82. In the embodiment shown in FIGS. 1, 2, and 5, the mechanical feature is a flange 84 that extends out from the interior surface 80 of the panel 78. The flange 84 has a geometry that mates with the geometry of the tub 12; e.g., the flange 84 fits within the side panel 24 or vice versa. The lid 14 preferably includes one or more outwardly extending ears 86 that can be pressed against during attachment or detachment of the lid 14 from the tub 12. In some embodiments where the container 10 is configured to house a replacement cartridge 16 that includes a razor cartridge 20 and/or one or more linkage members, the lid 14 may further include one or more locating features 88 that are operable to maintain the razor cartridge 20 (and/or the linkage members) in a predetermined position within the cavity 26 of the container 10. The locating features 88 shown in FIG. 5, for example, mate with the geometry of the razor cartridge 20 to securely hold the razor cartridge 20 between the riser 56 and the lid 14. Locating features 88 can also be attached to the lid 14 in a position to ensure the lid 14 is being attached to the tub 12 in the orientation intended; i.e., if the lid 14 is 180° away from the proper orientation, the feature 88 will prevent attachment between the lid 14 and the tub 12. Lids 14 other than that shown in the exemplary embodiment may be used alternatively. For example, as can be seen in FIG. 7, a lid consisting of a sheet 90 of material (e.g., a thermoplastic or a metallic foil) is adhered to the tub 12 over the cavity 26. Access to the replacement cartridge 16 is accomplished by peeling the material lid 90 off of the tub 12.

A seal 92 is utilized to limit the flow of gas into or out of the cavity 26 (i.e., "leakage") when the lid 14 is attached to the tub 12. In the embodiment shown in FIGS. 1 and 2, a raised bead 94 that extends around the outer surface 96 of the lid flange 84 is received within a mating arcuately shaped channel 98 that extends around the interior surface 44 of the side panel. When assembled, the bead 94 is received within the channel 98 in a slight interference fit. The fit between the mating bead 94 and channel 98 provides a sealing function and secures the lid 14 and the tub 12 together. Alternative seal arrangements can be used, including but not limited to those that use perforations or permeable materials in one or both the tub 12 or the lid 14 to allow a predetermined leakage rate under anticipated environmental conditions. The degree to which the lid 14 and the tub 12 form a seal with one another can be altered to suit the application at hand. In some instances, too small a gas leakage rate can cause a shaving aid body 18 to be adversely effected under certain circumstances; e.g., the growth of bacteria and/or fungi. On the other hand, an excessive leakage rate can facilitate the escape of volatile components from the shaving aid body 18; e.g., moisture, fragrance, etc. Hence, the leakage rate of the seal 92 is selected to reflect the application at hand and can be determined from empirical data developed using the particular shaving aid material.

Figure 9:
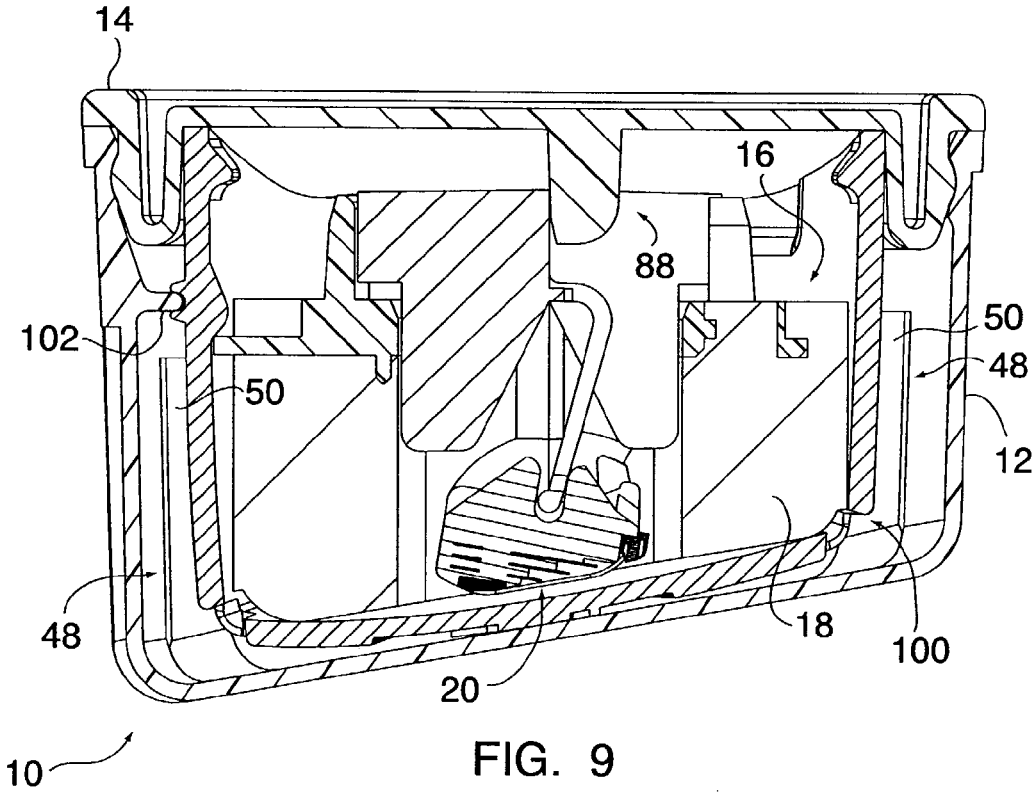
FIG. 9 is a diagrammatic sectional view of an embodiment of the present invention container with a replacement cartridge and cover disposed within the container.
Figure 10:
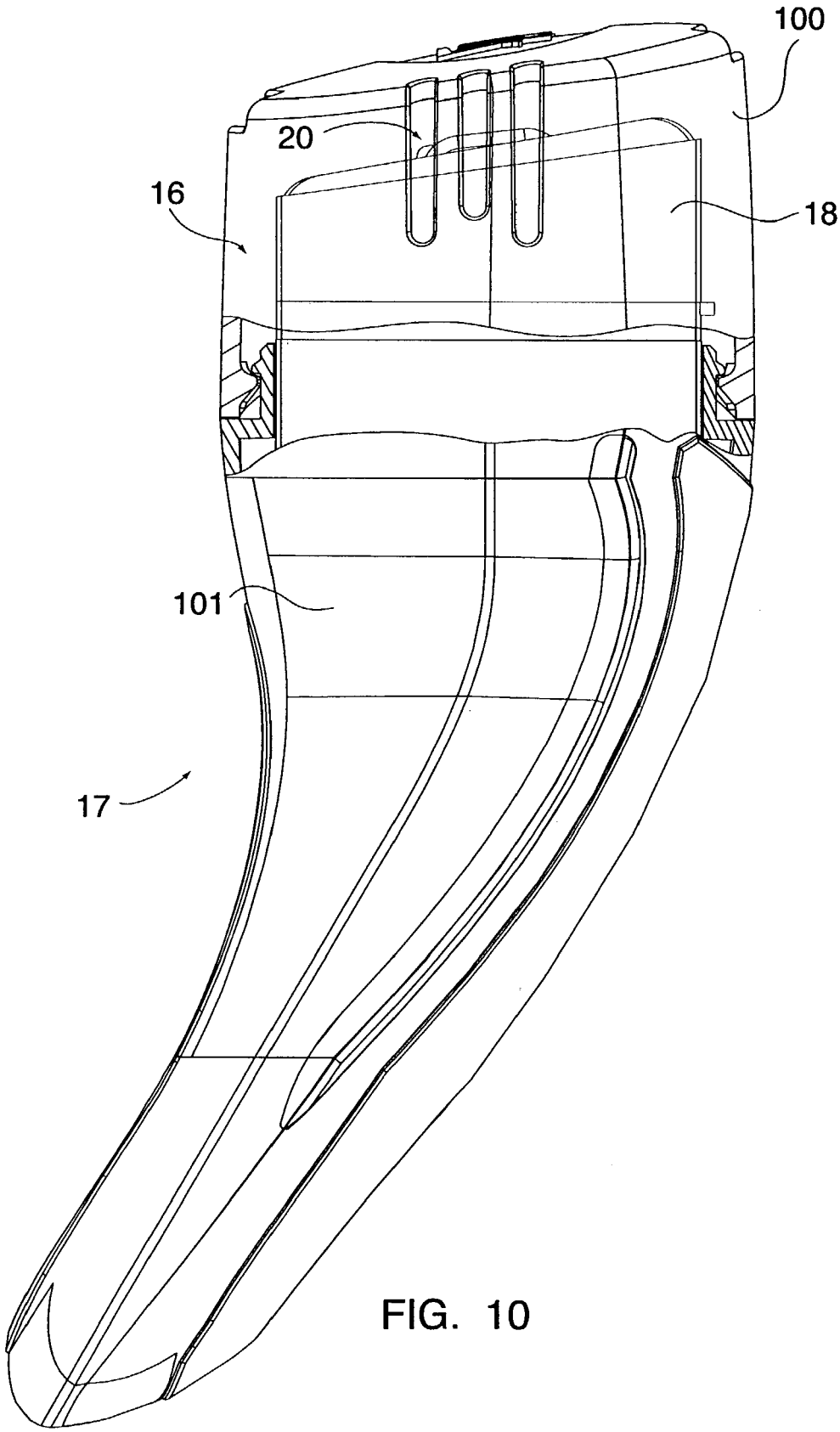
FIG. 10 is a diagrammatic view of a razor assembly including a razor assembly cover.

Referring to FIGS. 9 and 10, in an embodiment of the present invention, the container 10 is sized to receive both a replacement cartridge 16 and a cover 100 for a razor assembly 17. The cover 100 attaches to the handle 101 of the razor assembly 17. An example of a razor assembly cover 100 can be found in U.S. Provisional Patent Application Nos. 60/375,844 and application Ser. Nos. 60/405185 and 60/422697 respectively, which are hereby incorporated by reference herein. The cover 100 is shaped to enclose at least part of the replacement cartridge, including the shaving aid body 18 and the razor cartridge 20. In this embodiment, the above-described locating features 48 for locating the replacement cartridge 16 within the tub 12, can be used to locate the cover 100 within the tub 12. Locating features within the cover 100 can be used to locate the replacement cartridge 16. A mechanism 102 for securing the cover 100 within the tub 12 can also be included; e.g., similar to above described means 64 for securing the replacement cartridge 16 within the tub 12.

In some embodiments, the tub 12 portion of the present container 10 is shaped like the cover 100 so that it has utility both as a container 10 and a razor assembly cover 100. In such a case, the lid 14 is shaped to mate with the tub 12/cover 100 in a manner the same as or similar to that described above.

Although this invention has been shown and described with respect to the detailed embodiments thereof, it will be understood by those skilled in the art that various changes in form and detail thereof may be made without departing from the spirit and scope of the invention. For example, the present invention container 10 has been described above as having a tub 12 and a lid 14. In some applications, the container 10 may include only a tub portion.

What is claimed is:

1. A container for a razor assembly replacement cartridge, comprising:

a tub having a base panel and a side panel, wherein the base panel has an interior surface and an exterior surface, and the side panel has an interior surface and an exterior surface, wherein a cavity is formed contiguous with the interior surfaces of the base panel and the side panel;

a removable lid that attaches to the tub and forms a seal with the tub; and a plurality of locating features for locating the replacement cartridge within the cavity, wherein the plurality of locating features include:

a plurality of pedestals, each having a height extending from the interior surface of the base panel such that when the replacement cartridge is disposed within the cavity a shaving aid body portion of the replacement cartridge is disposed above the interior surface of the base panel; and a riser extending outwardly from the interior surface of the base panel, the riser including one or more locating surfaces for receiving a center aperture of the shaving aid body portion of the replacement cartridge, and one or more clips attached to the riser for selectively attaching a razor cartridge portion of the replacement cartridge to the riser.

2. The container of claim 1, further comprising a mechanism for securing the replacement cartridge within the tub.

3. The container of claim 2, wherein the mechanism for securing the replacement cartridge within the tub includes a first half of a mating mate and female couple that couples with a second half of the mating male and female couple attached to the replacement cartridge.

4. The container of claim 1, wherein the riser locates the razor cartridge portion in a predetermined position to facilitate attachment of the razor cartridge to the razor assembly.

5. The container of claim 4, wherein the lid comprises a first half of a mating male and female couple that couples with a second half of the mating male and female couple attached to the side panel, and wherein one of the first half or the second half is received within the other of the first half or the second half when the lid is attached to the tub.

6. The container of claim 5, wherein the lid further comprises one or more second locating features for locating the replacement cartridge within the cavity.

7. A container for a razor assembly replacement cartridge, comprising:

a tub having a base panel and a side panel, wherein the base panel has an interior surface and an exterior surface, and the side panel has an interior surface and an exterior surface, wherein a cavity is formed contiguous with the interior surfaces of the base panel and the side panel;

a mechanism for securing the replacement cartridge within the tub; and a removable lid that attaches to the tub;

wherein the replacement cartridge is inserted in the tub and includes at least a shaving aid body portion, and a razor cartridge portion; and wherein the mechanism for securing includes a mating male and female couple comprising:

a tab extending out from a shaving aid body portion of the replacement cartridge; and a slot formed in a first portion of the side panel, the slot sized to receive the tab;

wherein the side panel of the tub is elastically flexible and a predetermined amount of flexure of at least a second portion of the side panel releases the tab from the slot and the replacement cartridge from within the tub.

8. The container of claim 7, further comprising a plurality of locating features for locating the replacement cartridge within the cavity.

9. The container of claim 8, wherein the plurality of locating features include a plurality of pedestals, each having a height extending from the interior surface of the base panel, and wherein the height of the pedestals is great enough that the replacement cartridge is spaced above the interior surface of the base panel when the replacement cartridge is disposed within the cavity.

10. The container of claim 8, wherein the plurality of locating features further comprising a riser extending out from the base panel.

11. The container of claim 10, wherein the riser includes one or more locating surfaces for receiving a center aperture of a shaving aid body portion of the replacement cartridge.

12. The container of claim 10, further comprising one or more clips attached to the riser for selectively attaching a razor cartridge portion of the replacement cartridge to the riser.

13. The container of claim 12, wherein the riser locates the razor cartridge portion in a predetermined position to facilitate attachment of the razor cartridge to the razor assembly.

14. A container for a razor assembly replacement cartridge, comprising:

a base panel having an interior surface and an exterior surface;

a side panel having an interior surface and an exterior surface;

wherein a cavity is formed contiguous with the interior surfaces of the base panel and the side panel;

wherein the replacement cartridge is inserted in the cavity and includes at least a shaving aid body portion, a tab extending out from the shaving aid body, and a razor cartridge portion; and a mechanism for securing the replacement cartridge within the cavity, wherein the mechanism for securing includes a mating male and female couple comprising:

the tab extending out from the shaving aid body portion of the replacement cartridge; and a slot formed in a first portion of the side panel, the slot sized to receive the tab;

wherein the side panel is elastically flexible and a predetermined amount of flexure of at least a second potion of the side panel releases the tab from the slot and the replacement cartridge from within the cavity.

15. The container of claim 14, further comprising one or more locating features the replacement cartridge within the cavity.

16. The container of claim 15, wherein the locating features for locating the replacement cartridge within the cavity include a plurality of pedestals, each having a height extending from the interior surface of the base panel, wherein the height of the pedestals is great enough that the replacement cartridge is spaced above the interior surface of the base panel when the replacement cartridge is disposed within the cavity.

17. The container of claim 14, further comprising a lid that includes a feature that prevents attachment of the lid to the container unless the lid is in a predetermined orientation relative to the container.

18. The container of claim 14, wherein the container is shaped to permit attachment of the container to a razor assembly, thereby enabling the container to function as a razor assembly cover.

19. The container of claim 18, wherein the container further includes a lid that consists of a sheet of material adhered to the container over the cavity.

20. The container of claim 14, wherein the container further includes a lid that consists of a sheet of material adhered to the container over the cavity.

21. A container for a razor assembly comprising:

a base panel having an interior surface and an exterior surface;

a side panel having an interior and an exterior surface;

wherein a cavity is formed contiguous with the interior surfaces of the base panel and the side panel;

wherein the razor assembly includes a replacement cartridge and a razor assembly cover, the replacement cartridge including at least a shaving aid body portion and a razor cartridge portion, and wherein the razor assembly cover encloses the shaving aid body portion and the razor cartridge portion of the replacement cartridge;

one or more locating features for locating the razor assembly cover within the cavity; and a removable lid that attaches to the container, wherein the lid includes a mechanism for securing the replacement cartridge within the razor assembly cover;

wherein the cavity is sized to contain the replacement cartridge and the razor assembly cover when the razor assembly is placed within the container;

and wherein the replacement cartridge substantially fills the cavity when placed therein.

22. The container of claim 21 further comprising a mechanism for securing the cover within the cavity.

* * * * *